US005462449A

United States Patent [19]

Tsuji et al.

[11] Patent Number: 5,462,449

[45] Date of Patent: Oct. 31, 1995

[54] ELECTRICAL CONNECTOR WITH A FUNCTION OF DETECTING INTERFITTING ENGAGEMENT OF CONNECTOR HOUSINGS

[75] Inventors: Takeshi Tsuji; Masashi Saito, both of Yokkaichi, Japan

[73] Assignee: Sumitomo Wiring Systems, Ltd., Mie, Japan

[21] Appl. No.: 347,142

[22] Filed: Nov. 23, 1994

[30] Foreign Application Priority Data

Nov. 26, 1993 [JP] Japan ..... 5-321327

[51] Int. Cl.[6] ..... H01R 13/62

[52] U.S. Cl. ..... 439/188; 439/372; 439/489

[58] Field of Search ..... 200/51.09–51.11; 439/188, 350, 352–355, 357, 358, 372, 374, 488, 489, 509

[56] References Cited

U.S. PATENT DOCUMENTS 5,145,356 9/1992 Minnis ..... 439/489 X 5,376,017 12/1994 Taniuchi et al. ..... 439/489 X

FOREIGN PATENT DOCUMENTS 5-290917 11/1993 Japan .

*Primary Examiner*—Khiem Nguyen

*Attorney, Agent, or Firm*—Wenderoth, Lind & Ponack

[57] ABSTRACT

An electrical connector with a function of detecting interfitting engagement of connector housings includes first and second connector housings fitted one into the other into interfitting engagement, a plurality of pairs of terminals disposed in the respective connector housings and electrically connected together upon the interfitting engagement of the first and second connector housings, a short-circuiting terminal usually urged so as to make a short circuit between at least two of the terminals disposed in the second connector housing, an actuator displacing the short-circuiting terminal upon the interfitting engagement of the first and second connector housings so that the short-circuiting terminal is departed from the terminals disposed in the second connector housing, and a pair of interfitting engagement detecting terminals disposed in the first connector housing so that a short circuit is made between them by the short-circuiting terminal when it has been displaced.

6 Claims, 5 Drawing Sheets

ELECTRICAL CONNECTOR WITH A FUNCTION OF DETECTING INTERFITTING ENGAGEMENT OF CONNECTOR HOUSINGS

BACKGROUND OF THE INVENTION

1. Field of the Invention

This invention relates to an electrical connector with a function of detecting interfitting engagement of male and female connector housings.

2. Description of the Prior Art

Air bag system has rapidly come into wide use for protecting automobile drivers and passengers against shock upon occurrence of crash of automobiles. An operating circuit for the air bag system comprises terminals connected to an ignition device for a gas generating agent accommodated in an inflator and terminals connected via a crash sensor to a power source, these terminals being connected together by an electrical connector. When the crash sensor senses shock due to crash of the automobile, electric current is supplied to the ignition device so that the gas generating agent is ignited. A large amount of gas is produced in a moment and fed into a bag, thereby inflating it.

The air bag system is required to reliably operate in crash of the automobile while malfunction thereof needs to be avoided occasions other than occurrence of crash. Male and female terminals of the connector are disconnected when the air bag system is installed in the automobile or when the air bag system is inspected, for example. In this regard, the terminals accommodated in the connector housing at the side of the air bag are opened. Even in such a condition, there is a possibility that a magnetic or electric field generated around the connector induces voltage between the disconnected terminals. In this case, the electric current accidentally flows into the ignition device of the inflator, resulting in malfunction of the air bag system.

In view of the above-described problem, the prior art has provided an electrical connector with a function of preventing malfunction of the air bag system. The connector comprises male and female connector housings accommodating male and female terminals respectively. A pair of female terminals are connected to the ignition device of the inflator. A short-circuiting terminal is disposed in the female connector housing so that a short circuit is usually made between the pair of female terminals. The short-circuiting terminal is displaced to be away from the pair of female terminals when the female and male connector housings are fitted one into the other.

In the above-described connector, an operator needs to visually inspect as to whether or not the short-circuiting terminal has released the female terminals from the short-circuited condition in the interfitting engagement of the male and female connector housings. However, it is difficult to determine as to whether or not the female terminals have been released from the short-circuited condition, and the visual inspection for the determination is troublesome. This poses a problem.

SUMMARY OF THE INVENTION

Therefore, an object of the present invention is to provide an electrical connector wherein the release of the female terminals from the short-circuited condition by the short-circuiting terminals can be reliably detected.

To achieve the object the present invention provides an electrical connector comprising first and second connector housings fitted one into the other into interfitting engagement and a plurality of pairs of terminals disposed in the respective connector housings and electrically connected together upon the interfitting engagement of the first and second connector housing. A short-circuiting terminal is usually urged so as to make a short circuit between at least two of the terminals disposed in the second connector housing are usually short-circuited. An actuator is provided for displacing the short-circuiting terminal upon the interfitting engagement of the first and second connector housings so that the short-circuiting terminal is departed from said at least two terminals disposed in the second connector housing. A pair of interfitting engagement detecting terminals are provided in the first connector housing so that a short circuit is made therebetween by the short-circuiting terminal when the same has been displaced.

According to the above-described connector, the short-circuiting terminal usually makes a short circuit between the terminals accommodated in the first connector housing when the first and second connector housings are disengaged from each other. Upon interfitting engagement of the connector housings, the actuator displaces the short-circuiting terminal so that the terminals are released from the short-circuited condition. Simultaneously, the short-circuiting terminal makes another short-circuit between the interfitting engagement detecting terminals. Consequently, the interfitting engagement of the connector housings can be reliably detected electrically.

BRIEF DESCRIPTION OF THE DRAWINGS

Other objects, features and advantages of the present invention will become clear upon reviewing the following description of the preferred embodiment thereof, made with reference to the accompanying drawings, in which.

DESCRIPTION OF THE PREFERRED EMBODIMENTS

An embodiment of the present invention will be described with reference to FIGS. 1 to 8. In an electrical connector of the embodiment, a male connector 1 includes a plastic locking cover 3 formed into the shape of a hood and rotatably mounted thereon. The locking cover displaces a female connector 2 to a position of complete interfitting engagement with the male connector 1. The locking cover 3 is engaged with the female connector 3 when assuming the position of complete interfitting engagement.

Figure 1:
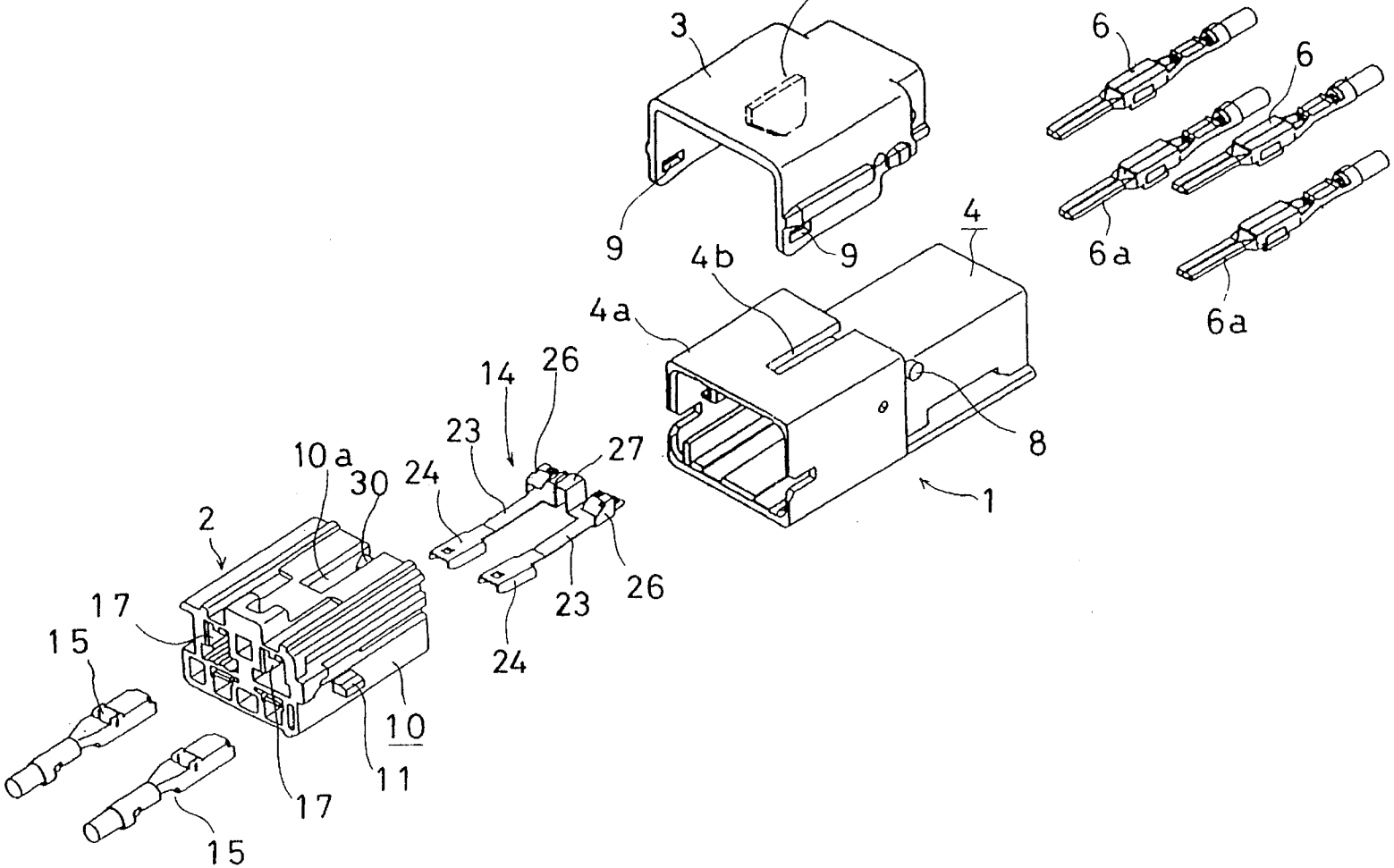
FIG. 1 is an exploded perspective view of one embodiment of an electrical connector in accordance with the present invention.
Figure 2:
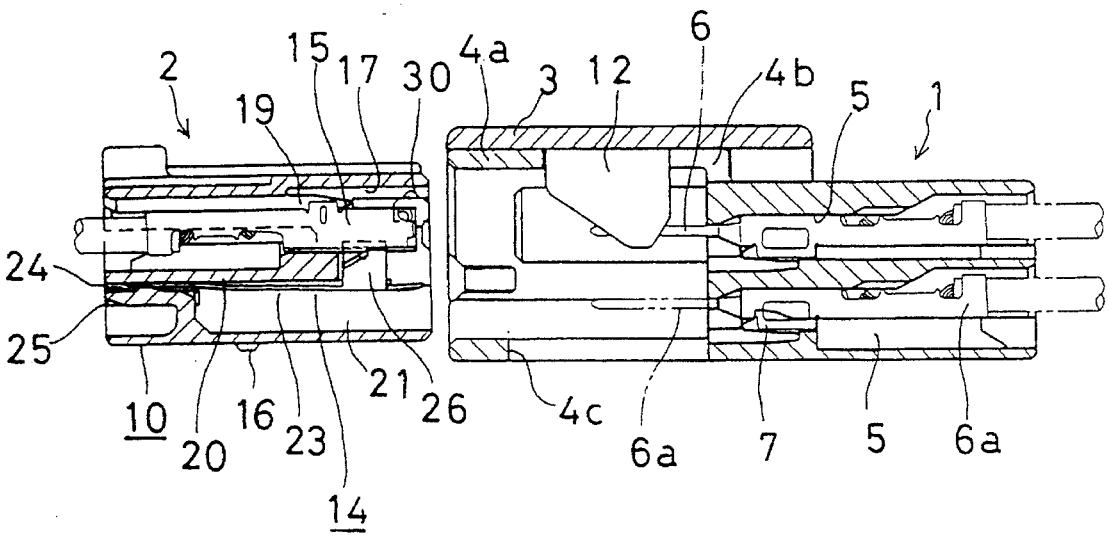
FIG. 2 is a longitudinally sectional view of the connector, showing the disengaged state of connector housings.

The male connector 1 includes a male connector housing 4 formed generally into the shape of a rectangular parallelepiped and having right-hand and left-hand side walls. The male connector housing 4 has a hood 4*a* in its front or the left-hand portion thereof as viewed in FIG. 1. The female connector 2 is to be fitted into the hood 4*a*. The rear interior of the male connector housing 4 or the right-hand interior thereof as viewed in FIG. 1 is partitioned into male terminal accommodating cavities 5 arranged in two rows and two columns, as shown in FIG. 2. Male terminals 6 are inserted into the respective cavities 5 through the rear opening of the male connector housing 4 respectively. One ends of the male terminals 6 project into the hood 4*a*. A lance 7 is provided on the inner wall of each male terminal accommodating cavity 5. The lance 7 engaged with the male terminal 6 for preventing the same from falling out of the cavity 5. A pair of male terminals 6 accommodated in the lower cavities 5 as viewed in FIGS. 2–5 are adapted to serve as interfitting engagement detecting terminals 6*a*, as will be described later. These terminals 6*a* are connected to an interfitting engagement detecting circuit (not shown). This circuit includes a short-circuit indicating lamp which is turned on when an electrical circuit between the terminals 6*a* has been short-circuited, for example.

The male connector housing 4 has a pair of support shafts 8 projecting from the rear right-hand and left-hand side walls thereof respectively. The locking cover 3 is rotatably mounted on the support shafts 8. The locking cover 3 is formed into such a shape that it covers the top and the right-hand and left-hand sides of the hood 4*a* of the male connector housing 4. The locking cover 3 is rotatably movable between a first state in which it lies along the top face of the male connector housing 4 and a second state in which it rises up from the first state. The locking cover 3 has two engagement holes 9 formed in the right-hand and left-hand side walls thereof respectively. Two engagement convexities 11 formed on the right-hand and left-hand side walls of a female connector housing 10 are engaged with the engagement holes 9 respectively upon interfitting engagement of the male and female connectors 1 and 2, whereby the connectors are held in the state of complete interfitting engagement. The locking cover 3 further has a triangular plate-shaped actuator 12 projecting from approximately the central inner top face thereof. The actuator 12 enters an actuator entry chamber 13 (see FIG. 8) upon interfitting engagement of the male and female connectors 1 and 2, pushing a short-circuiting terminal 14 downwardly to thereby release the female terminals from the short-circuited condition, as will be described later. In this regard, the hood 4*a* of the male connector 4 has an escape hole 4*b* formed in the top thereof and the female connector housing 10 also has an escape hole 10*a* formed in the top thereof. These escape holes 4*b* and 10*a* are formed so as to correspond to the entry chamber 13 to allow the actuator 12 to enter it therethrough when the connector housings 4 and 10 are fitted one into the other.

The female connector housing 10 of the female connector 2 is also formed generally into the shape of a rectangular parallelepiped. The female connector housing 10 has an engagement claw 16 formed on the underside thereof, as shown in FIG. 2. The claw 16 is engaged with the edge of an opening 4*c* formed in the underside of the hood 4*a* of the male connector 1 when the female connector 2 is inserted into the hood 4*a*, whereby the connectors 1 and 2 can be held in a provisional engagement state. The interior of the female connector housing 10 is partitioned into two female terminal accommodating cavities 17 by a partition plate 18 with the entry chamber 13 centrally located between the cavities 17. The entry chamber 13 is open upwardly so that the actuator 12 enters it through the escape holes 4*b* and 10*a*, as described above. A cam follower 30 is provided in the entry chamber 13 so as to connect the inner side walls of the chamber 30. The actuator 12 is abutted against the cam follower 30, as shown in FIG. 1.

The cavities 17 accommodate female terminals 15 which are electrically connected to the male terminals 6, respectively. Each cavity 17 also has a lance 19 formed on its inner wall. The lance 19 is elastically engaged with the female terminal 15, thereby preventing it from falling out of the cavity 17. The female terminals 15 are connected to one end of a signal line whose other end is connected to an ignition device for a gas generator of an air bag system, none of them being shown.

Another partition plate 20 is horizontally disposed in the female connector housing 10 as shown in FIG. 2. The partition plate 20 partitions the inner interior of the female connector housing 10 into the above-described upper female terminal accommodating cavities 17 and a lower chamber further partitioned by a partition plate 22 (FIG. 8) into two mounting chambers 21. Each mounting chamber 21 extends through the female connector housing 10. The partition plate 22 rises up from the central bottom of the lower chamber, extending substantially over the whole length of the female connector housing 10 and projecting into the entry chamber 13.

The short-circuiting terminal 14 includes a pair of short-circuiting pieces 23 disposed in the mounting chambers 21 respectively. Each short-circuiting piece 23 has a mounting portion 24 formed by bending right-hand and left-hand sides of its rear end downwardly. The mounting portions 24 of the short-circuiting pieces 23 are crimped to mounting pieces 25 projecting from the bottom of the mounting chambers 22 in the form of a hook, thereby holding the short-circuiting pieces 23, respectively. The short-circuiting pieces 23 extend from the respective mounting portions 24 along the underside of the partition plate 20. Spaces each having a predetermined height are retained between the short-circuiting pieces 23 and the bottom of the mounting chambers 21 respectively. The interfitting engagement detecting terminals 6*a* enter the respective spaces. Contact portions 26 rise from the distal ends of the short-circuiting pieces 23 of the short-circuiting terminal 14 respectively. The contact portions are formed to be able to come into contact with the corresponding female terminals 15 respectively. The contact portions 26 are usually located ahead of the distal end of the partition plate 20. Both contact portions 26 are connected together by a square inverse U-shaped connecting portion 27 in the entry chamber 13. The connecting portion 27 has approximately the same height as the contact portions 26. The short-circuiting terminal 14 is disposed with the connecting portion 27 thereof straddling the partition plate 22. The short-circuiting terminal 14 is adapted to elastically deform when pushed downwardly by the actuated 12, so that the female terminals 15 are released from the short-circuited condition. The short-circuiting terminal 14 usually makes a short circuit between the female terminals 15 in the disengagement of the female connector 2 from the male connector 1. The female terminals 15 are released from the short-circuited condition when the side of the contact portions 26 of the short-circuiting terminal 14 has been pushed downwardly. The short-circuiting terminal 14 then comes into contact with the interfitting engagement detecting terminals 6*a*, thereby making a short circuit therebetween.

The operation of the connector will now be described. Before interfitting engagement of the male and female connectors 1 and 2, each contact portion 26 of the short-circuiting terminal 14 is in elastic contact with the underside of each female terminal 15, thereby holding both female terminals 15 in the short-circuited condition. Accordingly, since occurrence of difference in the electric potential can be prevented between the female terminals 15, accidental electric current causing malfunction of the air bag system can be prevented from flowing into the ignition device of the air bag system.

Figure 3:
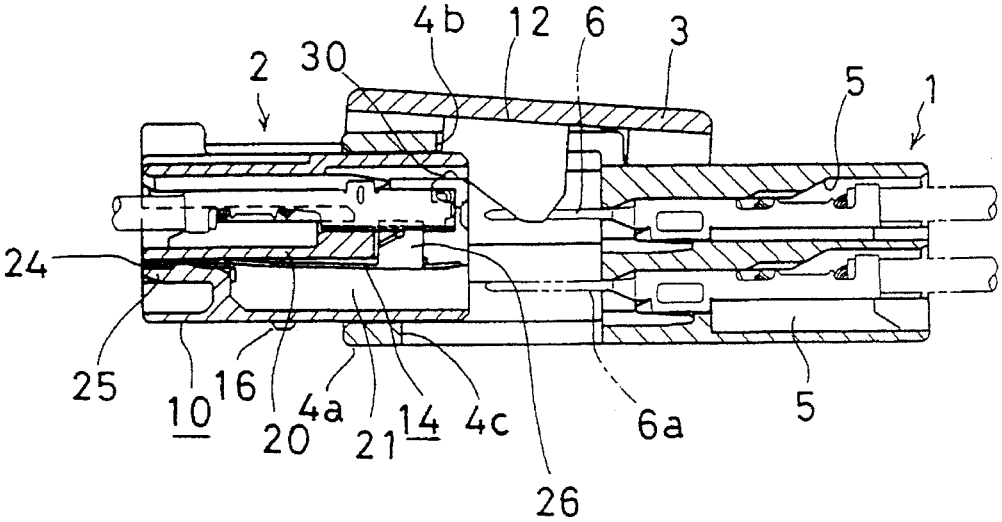
FIG. 3 is a longitudinally sectional view of the connector, showing the state at an initial stage of the interfitting operation.
Figure 4:
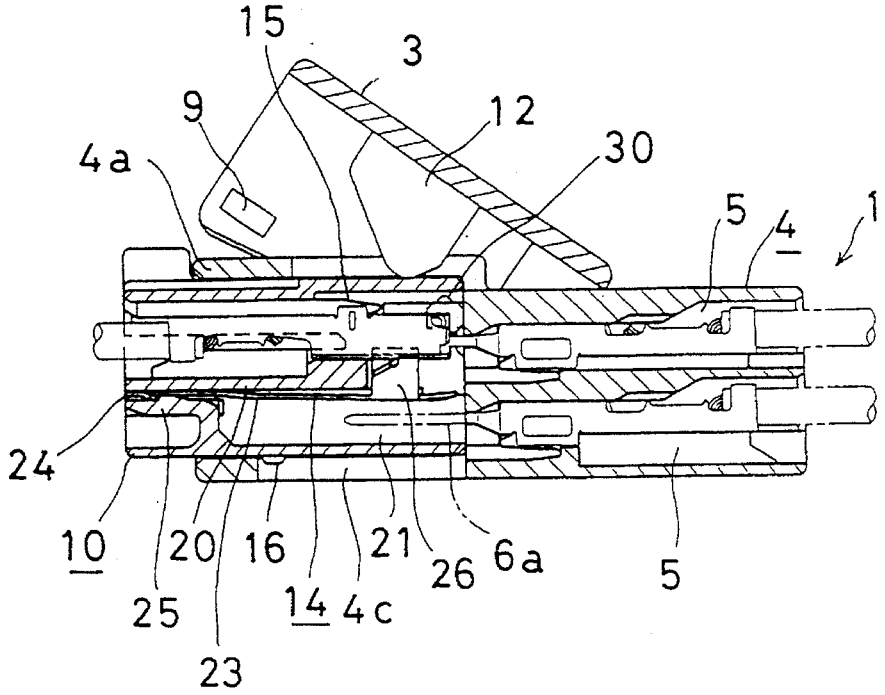
FIG. 4 is a longitudinally sectional view of the connector, showing the state at an intermediate stage of the interfitting operation.
Figure 5:
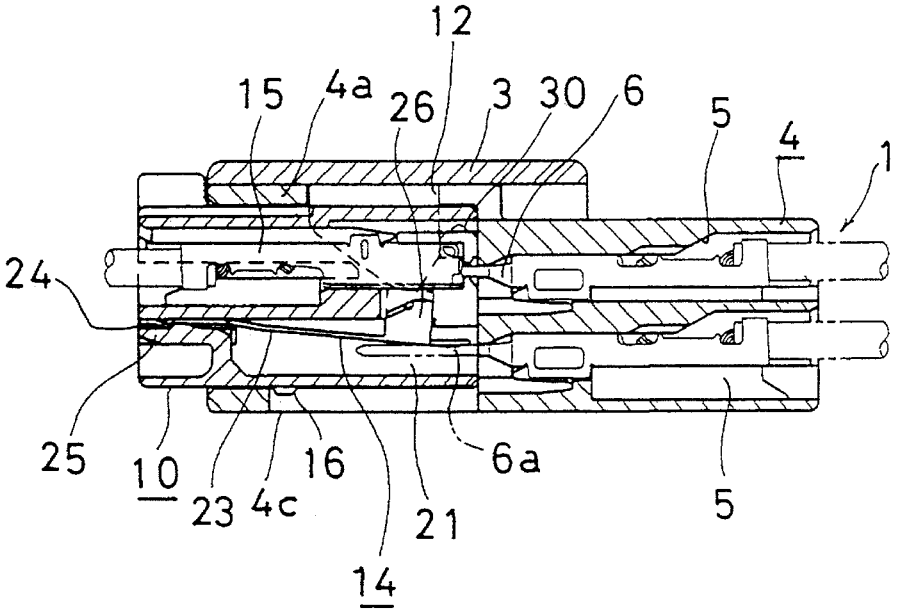
FIG. 5 is a longitudinally sectional view of the connector, showing the state in complete interfitting engagement.
Figure 6:
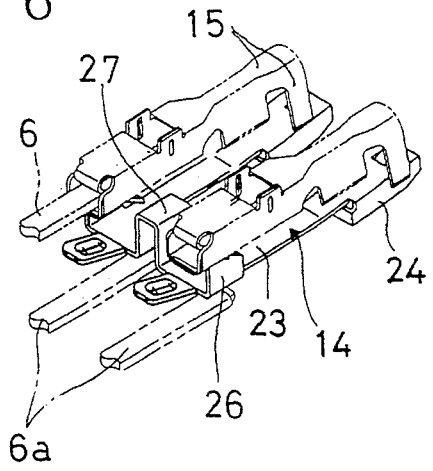
FIG. 6 is a perspective view of a short-circuiting terminal and female terminals between which a short circuit is made.
Figure 7:
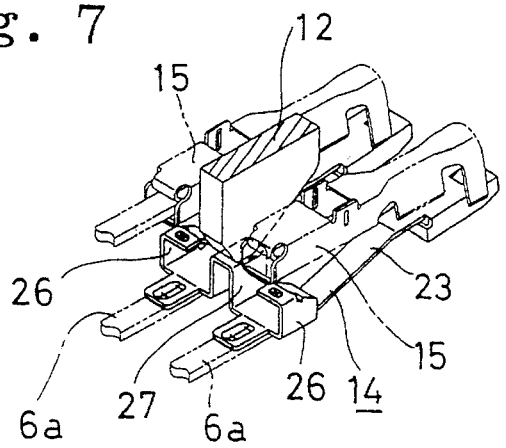
FIG. 7 is a perspective view of the short-circuiting terminal and pair of interfitting engagement detecting terminals between which a short circuit is made by the short-circuiting terminal.
Figure 8:
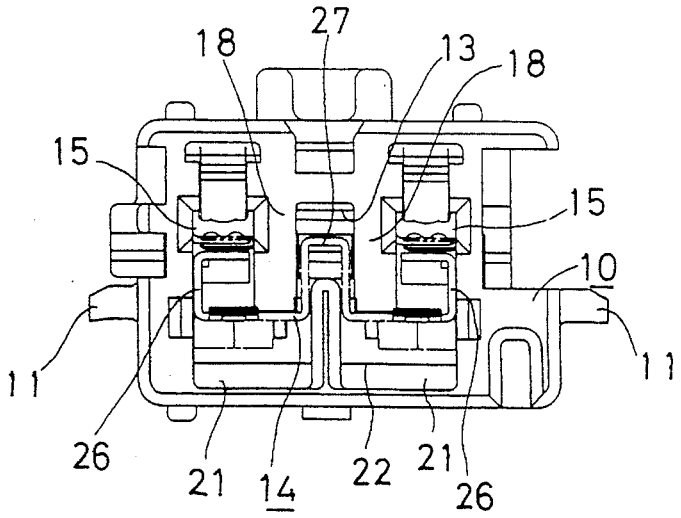
FIG. 8 is a front view of a female connector.

The locking cover 3 lies along the top of the male connector housing 4 before the interfitting engagement of the connectors 1 and 2. In an initial stage of the interfitting engagement, the actuator 12 of the locking cover 3 is abutted against the front edge of the cam follower 30 of the female connector housing 10 such that the locking cover 3 is caused to gradually rise up, as shown in FIG. 3.

Upon complete engagement of the connector housings 4 and 10, the male and female terminals 6 and 15 are connected together and the engagement claw 16 of the female connector 2 engages the edge of the opening 4*c* of the male connector 1. With completion of the interfitting engagement of the connectors 1 and 2, the escape holes 4*b* and 10*a* are located to correspond to the upper opening of the entry chamber 13, so that the actuator 12 is allowed to enter the entry chamber 13 over the cam follower 30. Then, the locking cover 3 is relocated so as to lie along the top of the male connector housing 4, and the engagement of engagement convexities 11 with the respective engagement holes 9 holds the connectors 1 and 2 in the state of complete interfitting engagement.

The locking cover 3 is rotatively moved so as to be pushed downwardly when the female connector housing 10 is inserted into the hood 4*a* until the cam follower 30 advances slightly over the distal end of the actuator 12. Then, the actuator 12 pushes the cam follower 30 forward or to the right as viewed in FIGS. 2–5 and accordingly, the female connector housing 10 is completely inserted into the hood 4*a* such that the connector housings 4 and 10 are completely engaged with each other.

Upon entry of the actuator 12 into the entry chamber 13, the distal end of the actuator 12 is abutted against the connecting portion 27 of the short-circuiting terminal 14, elastically deforming the same in such a direction that it is pushed downwardly. Consequently, the female terminals 15 are released from the short-circuited condition. Subsequently, the short-circuiting terminal 14 comes into contact with the interfitting engagement detecting terminals 6*a* in the mounting chamber 21 such that a short circuit is made between them. Since the terminals 6*a* are connected to an electric circuit (not shown) provided for detection of the interfitting engagement, the complete interfitting engagement of the connectors 1 and 2 is electrically detected as the result of the forming of the short-circuit between the terminals 6*a*. Consequently, the detection of the interfitting engagement of the connectors can reliably be performed, for example, by turning on an indicating lamp or activating a buzzer without reliance on visual inspection of the operator, which can improve reliability of the mounting and inspection of the connector. Furthermore, since the detection of interfitting engagement of the connectors makes use of the short-circuiting terminal releasing the female terminals from short-circuited condition, the construction of the connector can be simplified. Furthermore, since the short-circuiting terminal 14 has some spring force, it pushes the locking cover 3 up via the actuator 12 when the locking cover 3 is incompletely operated. The operator can understand incomplete interfitting engagement of the connectors immediately when viewing the raised locking cover 3.

The engagement convexities 11 are formed on the female connector housing 10. The convexities 11 are engaged with the respective engagement holes 9 formed in the locking cover 3 only when the connector housing 4 and 10 are located at the position of complete interfitting engagement. Accordingly, the locking cover 3 cannot be locked when the connector housings are in the state of incomplete interfitting engagement. Thus, the incomplete interfitting engagement can be readily found. Furthermore, the actuator 12 comes into contact with the cam follower 30 when the locking cover 3 is rotatively moved so as to lie along the top of the male connector housing 4 while the connector housing 4 and 10 are in the state of incomplete interfitting engagement. Consequently, the female connector housing 10 is thrust in such a direction that it is completely fitted with the male connector housing 4. The connector housings 4 and 10 can be prevented from remaining in the state of incomplete interfitting engagement.

Figure 9:
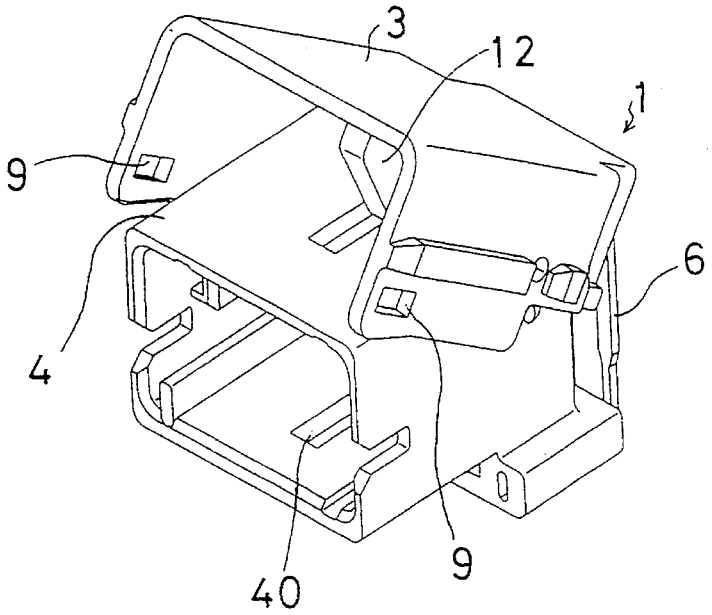
FIG. 9 is a perspective view of a male connector employed in another embodiment of an electrical connector in accordance with the present invention.
Figure 10:
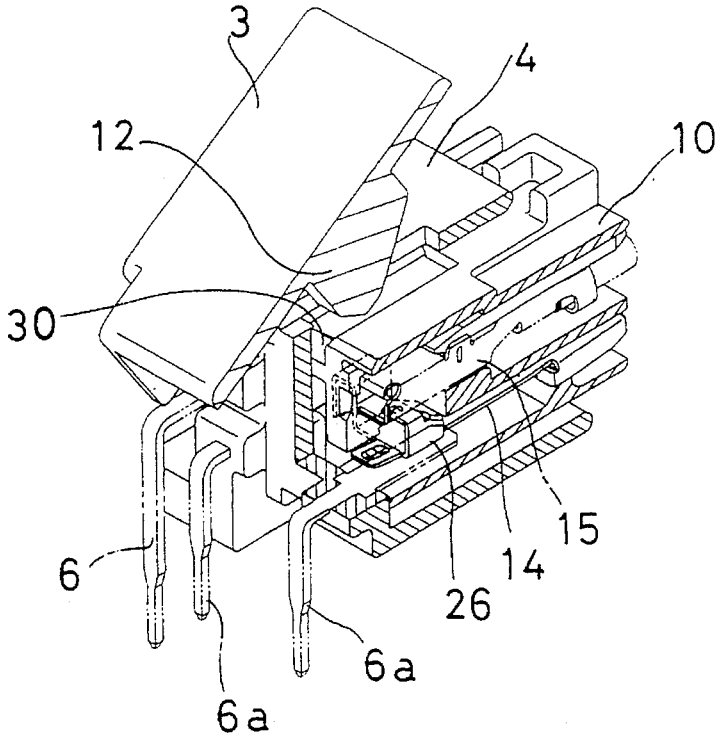
FIG. 10 is a partially broken perspective view of a female connector being fitted into the male connector.

FIGS. 9 and 10 illustrate a second embodiment of the present invention. In the second embodiment, the invention is applied to a type of connector different from that of the foregoing embodiment. The illustrated connector is of the type in which the male terminals 6 are connected to a printed circuit board. Referring to FIG. 9, a housing 4 of a male connector accommodates a plurality of male terminals 6. The male terminals 6 are drawn out through the rear open end of the male connector housing 4 and then bent downwardly in parallel with one another so that they can be connected to the side of the printed circuit board. The locking cover 3 with the actuator 12 is rotatably mounted on the male connector housing 4 as in the foregoing embodiment. The male connector housing 4 has a provisional engagement concavity 40 formed in the central bottom thereof. A provisional engagement protrusion (not shown) protruding from the underside of the female connector housing 10 is engaged with the concavity 40 so that the male and female connector housings 4 and 10 are maintained in the state of a provisional engagement. The male and female connector housings 4 and 10 are fitted one into the other into a normal interfitting engagement from the provisional engagement in the same manner as in the foregoing embodiment. The female connector housing 10 has the same inner construction as that in the foregoing embodiment. That is, the female connector housing 10 accommodates the short-circuiting terminal 14 usually making a short circuit between the female terminals 15. Upon interfitting engagement of the connector housings 4 and 10, the actuator 12 causes the terminal 14 to depart from the female terminals 15 and to come into contact with the interfitting engagement detecting terminals 6*a*.

The number and the shape of each of the male and female terminals should not be limited to those described above.

The foregoing description and drawings are merely illustrative of the principles of the present invention and are not to be construed in a limiting sense. Various changes and modifications will become apparent to those of ordinary skill in the art. All such changes and modifications are seen to fall within the true spirit and scope of the invention as defined by the appended claims.

We claim:

1. An electrical connector comprising:

a) first and second connector housings fitted one into the other into interfitting engagement;

b) a plurality of pairs of terminals disposed in the respective connector housings and electrically connected together upon the interfitting engagement of the first and second connector housings;

c) a short-circuiting terminal usually urged so as to make a short circuit between at least two of the terminals disposed in the second connector housing;

d) an actuator displacing the short-circuiting terminal upon the interfitting engagement of the first and second connector housings so that the short-circuiting terminal is departed from said at least two terminals disposed in the second connector housing; and e) a pair of interfitting engagement detecting terminals provided in the first connector housing so that short circuit is made therebetween by the short-circuiting terminal when the same has been displaced.

2. An electrical connector according to claim 1, wherein the actuator integrally projects from cover mounted on the first connector housing so as to be rotatively moved between a first state in which the cover lies along the outer surface of the first connector housing and a second state in which the cover rises from the first state.

3. An electrical connector according to claim 2, wherein the cover has right-hand and left-hand side walls and is formed into the shape of a hood covering a part of the first connector housing and the side walls of the cover are rotatably mounted on respective shafts further formed on the first connector housing.

4. An electrical connector according to claim 3, wherein the second connector housing includes a cam follower with which the actuator is brought into contact in the process of interfitting engagement of the connector housings and the actuator is abutted against the cam follower when the cover is rotatively moved to assume the first state in the condition that the connector housings are in an incomplete interfitting engagement, thereby thrusting the second connector housing in the direction of the complete interfitting engagement.

5. An electrical connector according to claim 3, wherein the first connector housing has two engaging convexities and the cover has in the right-hand and left-hand side walls thereof apertures the engaging convexities of the first connector housing engage respectively when the connector housings are in a normal position for the interfitting engagement.

6. An electrical connector comprising:

a) a female connector housing;

b) a plurality of female terminals accommodated in the female connector housing;

c) a male connector housing interfitting with the female connector housing and having right-hand and left-hand side walls, the male connector housing having support shafts projecting from the side walls respectively;

d) a plurality of male terminals accommodated in the male connector housing, the male terminals being electrically connected to the female terminals respectively upon the interfitting engagement of the female and male connector housings;

e) a short-circuiting terminal disposed in the female connector housing and usually urged so as to come into contact with at least one pair of the female terminals, thereby making a short circuit between the female terminals;

f) a cover formed into the shape of a hood covering part of each of the side walls of the male connector housing, the cover being rotatably mounted on the support shafts of the male connector housing so as to be movable between a first state in which the cover lies along a plane between the right-hand and left-hand side walls of the male connector and a second state in which the cover rises up from the first state, the cover having right-hand and left-hand side walls having engagement holes respectively;

g) an actuator formed integrally with the cover and displacing the short-circuiting terminal upon the interfitting engagement of the male and female connector housings, so that the short-circuiting terminal is departed from the female terminals;

h) a cam follower provided in the female connector housing so that the actuator comes into contact therewith in the process of interfitting engagement of the male and female connector housings, the cam follower being abutted by the actuator when the cover is rotatively moved to assume the first state while the connector housings are in the state of incomplete interfitting engagement, whereby the female connector housing is thrust in such a direction that the same completely interfits with the male connector;

i) a pair of interfitting engagement detecting terminals provided in the female connector housing so that a short circuit is made therebetween by the short-circuiting terminal when the same is displaced by the actuator to be away from the female terminals: and j) a pair of engaging convexities provided on the female connector housing so as to engage the engagement holes of the cover respectively when the connector housings have reached the state of normal interfitting engagement.

* * * * *